United States Patent [19]

Niemetz

[11] Patent Number: 4,784,273

[45] Date of Patent: Nov. 15, 1988

[54] SINGLE SERVING CONTAINER FOR TORTES OR THE LIKE

[76] Inventor: Walter Niemetz, Gitzen 57, 5322 Hof, Austria

[21] Appl. No.: 82,285

[22] Filed: Aug. 6, 1987

[51] Int. Cl.[4] ..... B65D 85/72

[52] U.S. Cl. ..... 206/634; 206/45.32; 206/551; 229/107

[58] Field of Search ..... 206/634, 627, 628, 45.32, 206/551, 557; 229/107

[56] References Cited

U.S. PATENT DOCUMENTS

| | | | |
|---|---|---|---|
| 3,259,235 | 7/1966 | Sowle | 206/627 |
| 3,620,411 | 11/1971 | Rump | 206/551 |
| 4,339,041 | 7/1982 | Roberts et al. | 206/551 |
| 4,373,636 | 2/1983 | Hoffman | 206/551 |
| 4,413,725 | 11/1983 | Bruno et al. | 206/627 |

FOREIGN PATENT DOCUMENTS

| | | | |
|---|---|---|---|
| 2140732 | 8/1980 | Fed. Rep. of Germany | 206/608 |
| 652370 | 11/1985 | Switzerland | 206/551 |

*Primary Examiner*—Willis Little

*Attorney, Agent, or Firm*—Cushman, Darby & Cushman

[57] ABSTRACT

A frangible, single-serving container for tortes and the like. The container comprises a base member for holding and serving the piece of torte or the like. The base member has a sector shaped base, a shallow base wall around the sector-shaped perimeter of the base, and a top rim on an upper edge of the base wall. The container also comprises a cover member for covering and protecting the piece of torte or the like. The cover member has a sector-shaped top, an arc-shaped back wall, two radial walls, and a bottom rim. The radial walls define a front edge, and the rim defines a bisected tab adjacent the front edge. The front edge is torn when the halves of the tab are forced in the opposite directions.

5 Claims, 2 Drawing Sheets

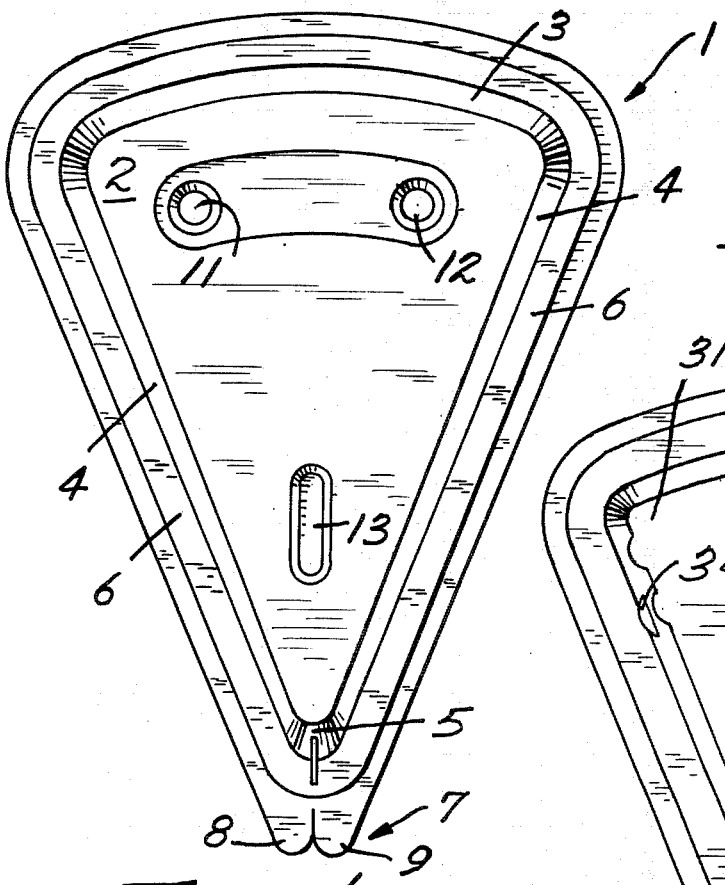
Fig. 1.
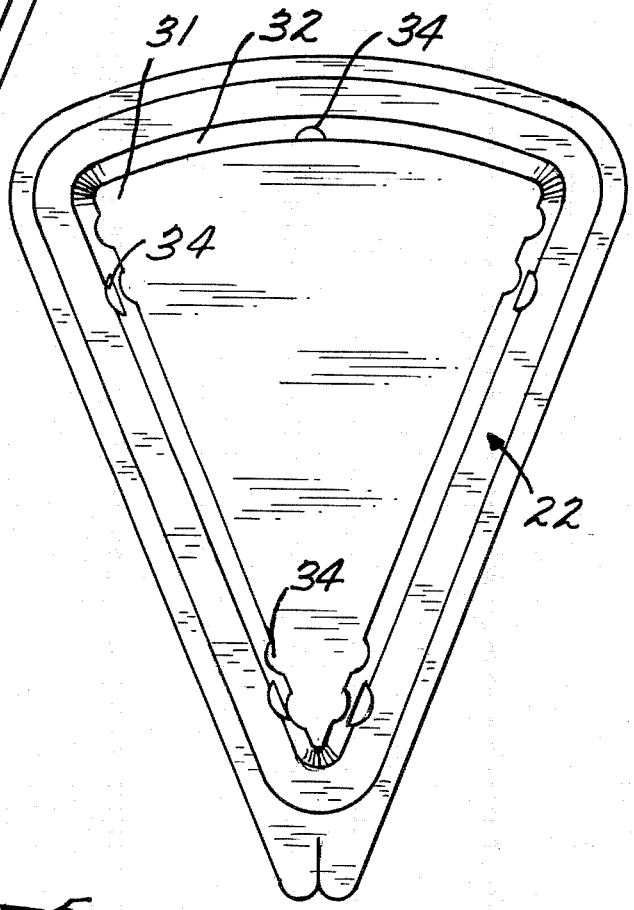
Fig. 3.
Fig. 2.
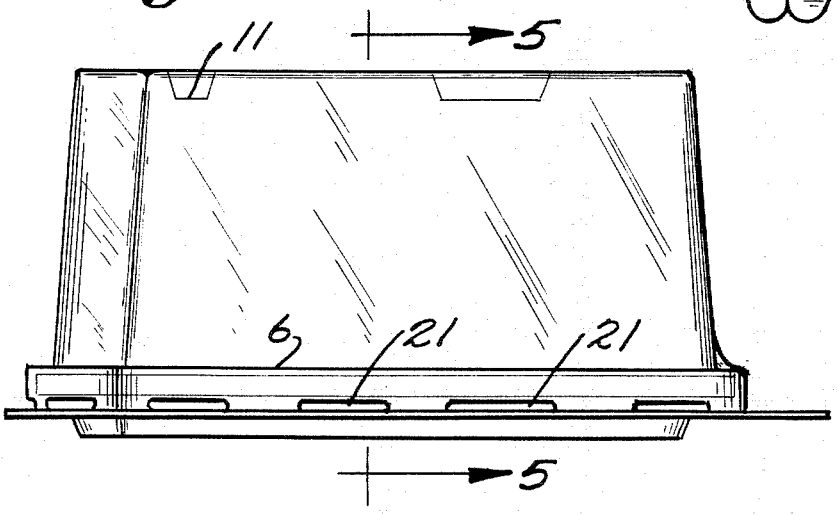

SINGLE SERVING CONTAINER FOR TORTES OR THE LIKE

BACKGROUND OF THE INVENTION

The present invention relates to single serving containers for tortes or similar pastries.

In recent years the demand for food products in single-serving containers has sky-rocketed. A huge market has opened up catering to the single, working person or two- wage-earner family. Some food products such as frozen TV dinners have been on the market for decades.

Most recently, a large market has developed for single servings of so-called gourmet foods. This market is composed of individuals with more discriminating palates and greater disposable incomes. Some products catering to this market such as croissant or other relatively non-fragile pastries lend themselves easily to being packaged as single servings. Other foods, such as tortes and frosted cakes are more difficult to package as single servings.

Finely decorated tortes or frosted cakes, when individually wrapped, tend to be crushed by their packages, stick to the sides of their packages and otherwise have much less aesthetic appeal than when served in a fine kondeterei or cafe.

It is therefore an object of the present invention to provide an easily-opened container for storing and serving single serving portions of cakes, tortes, or the like.

It is a further object of the present invention to provide a container in which finely decorated cakes and tortes may be stored, and from which they may be removed without destroying their decoration or aesthetic appeal.

SUMMARY OF THE INVENTION

In accordance with the above objects, there has been provided a frangible, single serving container for tortes and the like.

The container comprises a sector-shaped base member for holding and serving a piece of torte or the like. The base member includes a sector-shaped base defining a first sector-shaped perimeter, a shallow base wall around the perimeter of the base, and a top rim on an upper edge of the base wall.

The container also comprises a sector-shaped cover member for covering and protecting the piece of torte. The cover member has a sector-shaped top, an arc-shaped back wall, first and second radial walls for defining a front edge, and a bottom rim defined by the back and radial walls for engaging the top rim of the base member. The bottom rim defines a bisected tab having two halves and adjacent to the front edge. The front edge is torn when the halves of the tab are forced in opposite directions.

In accordance with a preferred embodiment of the present invention, the sector-shaped top further comprises boss means for engaging the piece of tort or the like and preventing the piece from touching the walls of the cover member.

Preferably, the sector-shaped cover member further comprises fold means disposed on the front edge adjacent to the bottom rim. The fold means act to create a stress region for guiding a tear along the front edge when the halves of the tab are forced in the opposite directions.

The upper edge of the base wall of the base member preferably defines a second sector-shaped perimeter having a greater radius than the first perimeter.

Second boss means are preferably disposed on the bottom rim for engaging the top rim.

Further objects, features and advantages of the present invention will become apparent from the description of preferred embodiment which follows, when considered in conjunction with the attached figures of drawing.

BRIEF DESCRIPTION OF THE DRAWINGS

In the drawings:

FIG. 1 is a top view of the view of the cover member according to the present invention;

FIG. 2 is a side view of the container according to the present invention in which the base member and cover member are engaged;

FIG. 3 is a bottom view of the container according to the present invention in which the cover member and base member are engaged;

DESCRIPTION OF THE PREFERRED EMBODIMENT

Figure 4:
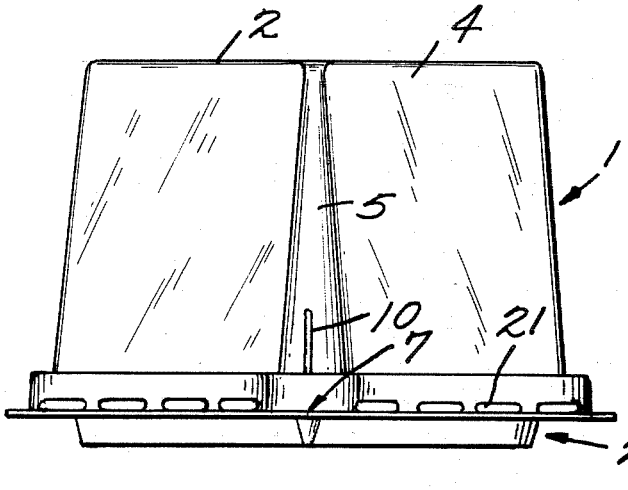
FIG. 4 is a front view of the container according to the present invention.

FIG. 1 shows a sector-shaped cover member 1 seen from the top. Cover member 1 comprises a sector-shaped top 2, an arc-shaped back wall 3, radial walls 4 and bottom rim 6. Radial walls 4 define a front edge 5. A bisected tab 7 is disposed anterior to edge 5 on rim 6. Tab 7 comprises halves 8, 9. Fold means 10 is disposed on edge 5 adjacent rim 6. Fold means 10 are preferably a fold of plastic disposed to act as a stress point so that when halves 8, 9 of tab 7 are moved in opposite directions, a tear is directed up edge 5.

Circular bosses 11, 12 and oval boss 13 extend inward, in the direction of rim 6, from top 2. The boss means are intended to hold a piece of torte or the like in place when the cover member engages the base member 22 as shown in FIG. 2. Boss means according to the present invention may be of any suitable shape for engaging the top of a piece of torte held in the present container. The number and configuration of boss means may be adjusted according to the type of pastry contained.

Boss means 12, 13 are seen extending into cover member 1 toward rim 6 in FIG. 2. Cover member 1 engages base member 22 by means of rim 6 and elongated boss means 21. Boss means 21 extend under rim 33 of base member 22 and hold cover 1 onto base 22.

As seen in FIG. 3, base member 22 comprises sector-shaped base 31. Base member 22 also comprises a shallow base wall 32 around the sector-shaped perimeter of base 31. A top rim 33 is disposed around the sector-shaped upper edge 35 of base wall 32. Base member 22 also comprises a plurality of engaging notches 34 for holding base member 22 in an automated conveyor device or the like, so that a single serving of torte can be automatically loaded onto base member 22. Cover member 1 is preferably also automatically engaged with base member 22 when the single serving of torte or the like has been loaded onto base members 22.

It has been found that when cream-based products are automatically loaded into the container of the present invention, shelf lives of up to sixteen months can be obtained at temperatures of −20° C. without preservatives. Cream products are contaminated only when they come into contact with humans before pasteurization. Automatically loaded pastries thus have a much longer shelf life even without preservatives.

FIG. 4 is a front view of the container according to the present invention with cover member 1 engaging base member 22. FIG. 4 nicely illustrates the alignment of tab 7 and fold means 10.

Figure 5:
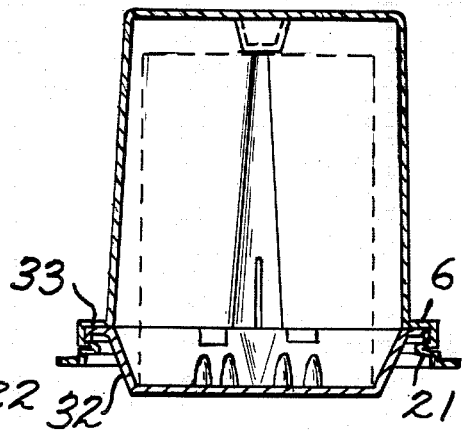
FIG. 5 is a cross sectional view along the line A—A in FIG. 2.

FIG. 5 is a cross section of the container according to the present invention in which the cover member 1 engages base member 22. Elongated boss means 21 can be seen extending under rim 33 of base member 22. Boss means 21 thus hold rim 6 onto rim 33. In cross section, base wall 32 is seen to be inclined toward rim 33. In this manner, the base wall 32 is prevented from sticking to the piece of torte. Base wall 32 defines an upper edge 50 having a sector-shaped perimeter with a greater radius than base 31.

Figure 6:
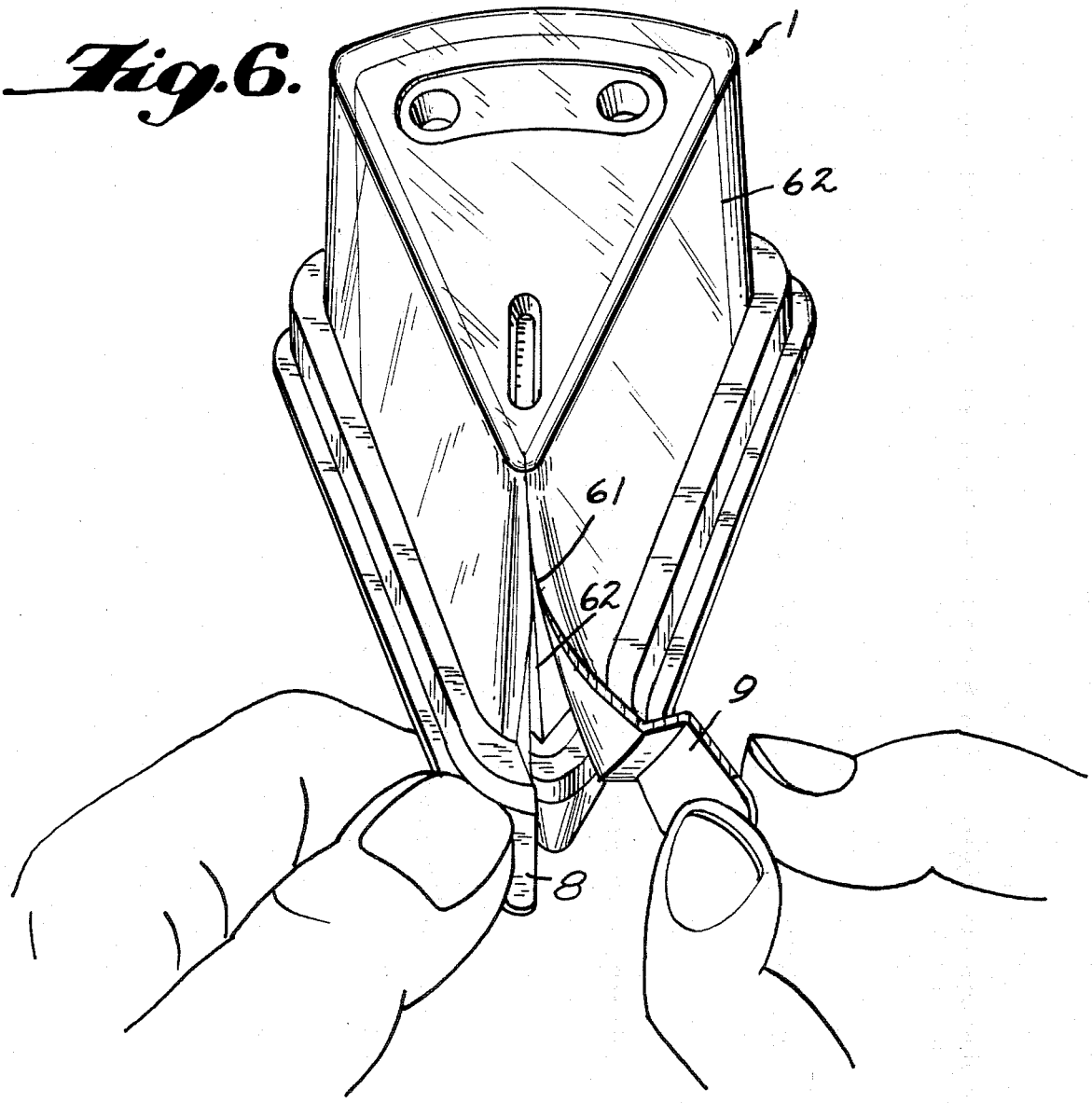
FIG. 6 is a front prospective view of the container according to the present invention showing the front edge being torn and the container being opened.

FIG. 6 is a perspective view of the container according to the present invention. Single serving 62 of torte or the like can be seen through transparent cover member 1. As halves 8, 9 of tab 7 are forced in opposite directions, a tear 61 results in front edge 5. Fold means 10 direct the tear up edge 5 so that cover member 1 can be easily removed from base member 22. Once the tear on edge 5 is complete, cover member 1 is tilted backwards (into the plane of the page in FIG. 6) and removed without damaging single serving 62. Base member 22 can thereafter be used as an attractive serving dish for single serving 62. At no point during storage or during the removal of cover 1, do radial walls or arc-shaped back wall 3 of cover member 1, touch the sides or back of single serving 62.

In lieu of fold means 10, the material of cover member 1 can be made thinner in the region of edge 5. A portion of rim 6 anterior to edge 5 may also be made slightly thinner to facilitate the tearing of edge 5.

The cover member 1 and base member 22 may be of like or different suitable materials. Preferably, cover member 1 is made of a transparent polymeric material, and base member 22 of an opaque material.

What is claimed is:

1. A frangible, single-serving container for tortes and the like, comprising:

a base member for holding and serving a piece of torte or the like, having a sector-shaped base defining a first sector-shaped perimeter, a shallow base wall around the perimeter of the base, and a top rim on an upper edge of the base wall; and a cover member for covering and protecting said piece of torte, having a sector-shaped top, an arc-shaped back wall, first and second radial walls, said radial walls defining a front edge, a bottom rim defined by said back and radial walls for engaging said top rim, said bottom rim defining a bisected tab having two halves adjacent said front edge, wherein said front edge is torn when the halves of the tab are forced in opposite directions.

2. A container as claimed in claim 1, wherein upper edge of the base wall defines a second sector shaped perimeter having a greater radius than said first perimeter.

3. A container as claimed in claim 1, wherein said cover member further comprises second boss means disposed on said bottom rim for engaging said top rim.

4. A frangible, single-serving container for tortes and the like, comprising:

a base member for holding and serving a piece of torte or the like, having a sector-shaped base defining a first sector-shaped perimeter, a shallow base wall around the perimeter of the base, and a top rim on an upper edge of the base wall; and a cover member for covering and protecting said piece of torte, having a sector-shaped top, an arc-shaped back wall, first and second radial walls, said radial walls defining a front edge, a bottom rim defined by said back and radial walls for engaging said top rim, said bottom rim defining a bisected tab having two halves adjacent said front edge, wherein said front edge is torn when the halves of the tab are forced in opposite directions;

wherein said sector-shaped top further comprises first boss means for engaging said piece of torte or the like and preventing the piece from touching the walls of the cover member.

5. A frangible, single-serving container for tortes and the like, comprising:

a base member for holding and serving a piece of torte or the like, having a sector-shaped base defining a first sector-shaped perimeter, a shallow base wall around the perimeter of the base, and a top rim on an upper edge of the base wall; and a cover member for covering and protecting said piece of torte, having a sector-shaped top, an arc-shaped back wall, first and second radial walls, said radial walls defining a front edge, a bottom rim defined by said back and radial walls for engaging said top rim, said bottom rim defining a bisected tab having two halves adjacent said front edge, wherein said front edge is torn when the halves of the tab are forced in opposite directions;

wherein said sector-shaped cover member further comprises fold means disposed on said front edge adjacent the bottom rim for creating a stress region for guiding a tear along the front edge when said halves of the tab are forced in opposite directions.

* * * * *